US005154303A

United States Patent [19]

Jordan

[11] Patent Number: 5,154,303

[45] Date of Patent: Oct. 13, 1992

[54] CONTAINER INSERTS

[76] Inventor: Raymond L. Jordan, #4 Fairhope Ct., Annapolis, Md. 21403

[21] Appl. No.: 738,930

[22] Filed: Aug. 1, 1991

Related U.S. Application Data

[63] Continuation-in-part of Ser. No. 349,123, May 8, 1989, Pat. No. D. 325,821.

[51] Int. Cl.[5] ..... B65D 75/00

[52] U.S. Cl. ..... 220/23.86; 220/555; 220/553; 220/759; 206/506

[58] Field of Search ..... 220/4.26, 4.27, 556, 220/553, 516, 517, 23.86, 23.83, 555, 94 A, 527; 206/505, 506

[56] References Cited

U.S. PATENT DOCUMENTS

| | | | |
|---|---|---|---|
| 76,905 | 4/1868 | Foote | 220/4.26 |
| 1,451,146 | 4/1923 | Fate | 220/4.27 |
| 1,573,620 | 2/1926 | Allston | 220/4.27 |
| 1,810,080 | 6/1931 | Kegel | 220/4.27 |
| 2,052,475 | 8/1936 | Jones et al. | 220/4.27 |
| 2,575,299 | 11/1951 | Scheel | 220/4.27 |
| 3,509,813 | 5/1970 | Appelt | 220/4.27 |
| 3,608,770 | 9/1971 | Naimoli | 220/556 |
| 4,428,145 | 1/1984 | Wheeler | 220/4.27 |
| 4,560,850 | 12/1985 | Levendusky et al. | 219/10.55 E |
| 4,895,256 | 1/1990 | Johnston | 220/4.27 |

*Primary Examiner*—Joseph Man-Fu Moy
*Attorney, Agent, or Firm*—Richard C. Litman

[57] ABSTRACT

Inserts and a remover are disclosed for use with containers such that the interior space of the container is utilized in the most efficient way. The inserts are sectioned off so that each insert has a plurality of sections. The inserts are further designed with a cylindrical center and outer section that are conical in nature. Each center section includes a cross section for removing the inserts from the container. Further disclosed is a handle for aiding in the removal of the inserts.

11 Claims, 1 Drawing Sheet

CONTAINER INSERTS

CROSS-REFERENCE TO RELATED APPLICATION

This application is a continuation-in-part of U.S. patent application Ser. No. 07/349,123 filed on May 8, 1989. Now U.S. Pat. No. D325821.

FIELD OF THE INVENTION

The present invention is an improvement over applicant's prior application. The present invention relates to container inserts which have sections that may be used for nails, screws, connectors, food or the like. The present invention further includes cross means for removing the inserts from the container.

DESCRIPTION OF THE RELATED ART

Attempts have been made to make a container with inserts. Such an attempt is shown in U. S. Pat. No. 4,911,295 issued to Venrgoni. However the prior art fails to disclose or suggest applicant's invention. Applicant's invention discloses an insert for use with containers having inner and outer annular walls. The inner wall has height greater than the outer wall. Further disclosed is cross means being located inside the inner wall.

SUMMARY OF THE INVENTION

The present invention relates to container inserts that can be used for storing and separating objects. The objects may be nails, screws, connectors, food or the like. The inserts have inner and outer annular walls being attached to a planer circular bottom. The inner wall has a height that is greater than the outer wall. Connected between the two walls are sectional members. These members may or may not evenly spaced apart from each other. The height of the sectional members is less than the height of either the inner or outer walls. Accordingly an object of the present invention is to provide a container insert with an inner annular wall that is greater in height than the outer wall An another object of the present invention is to provide cross means inside the inner wall.

A further object of the present invention is to provide a plurality of inserts for use within a single container.

A still further object of the present invention is to have the cross means designed with its center height being smaller than its outer areas.

Still another object of the present invention is to have means for removing the inserts from the container.

These and other objects regarding the features on the instant invention will become apparent to those skilled in the art, such as, having inserts without the sectional means for holding cables, larger tools, etc.

DESCRIPTION OF THE PREFERRED EMBODIMENT

Figure 1:
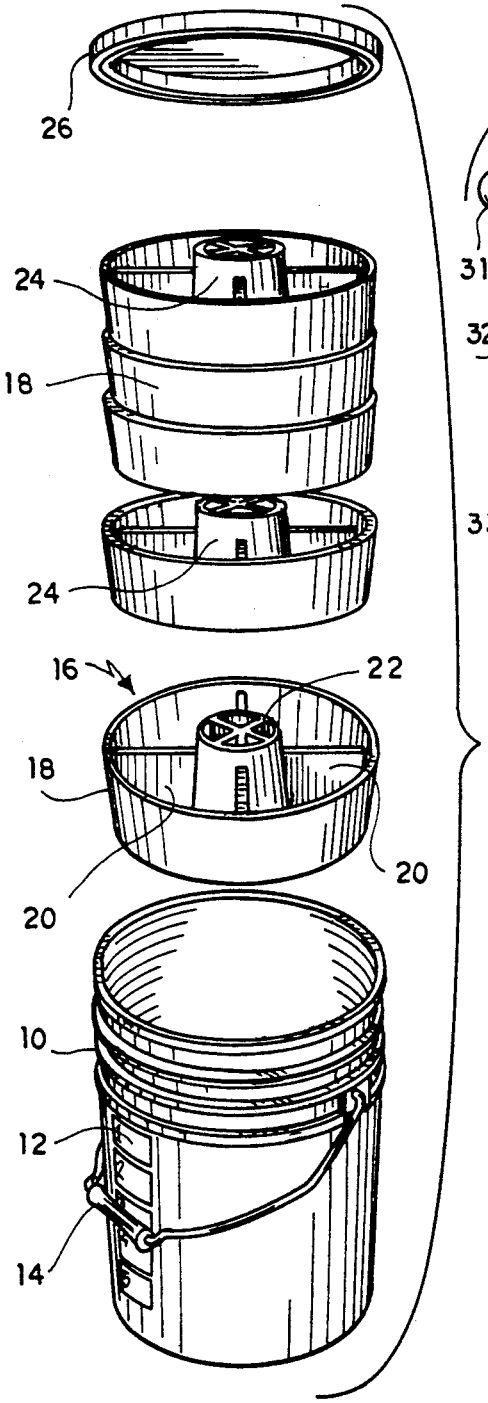
FIG. 1 is a perspective view of inserts being placed into a container.

Referring to the figures, more particularly by reference numerals, a container 10 receives a plurality of inserts 16, a rod 30, and is covered by a lid 26. The container 10 may be carried around by a handle 14. The container 10 also have labels 12, which may be used for writing down the contents within a specific insert 16.

Figure 2:
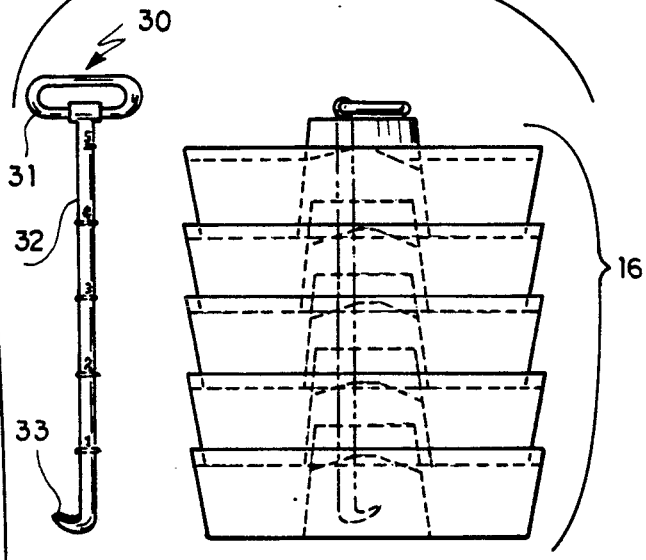
FIG. 2 shows the inserts being stacked and a handle for removing the inserts.
Figure 3:
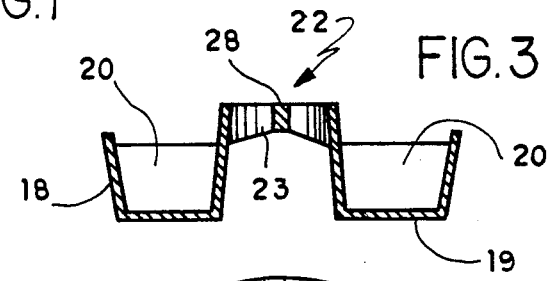
FIG. 3 is a cross sectional view of the insert.
Figure 4:
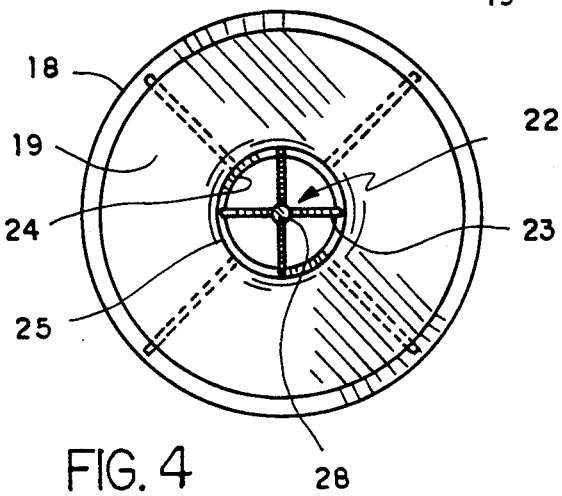
FIG. 4 shows the bottom view of the insert.

The inserts 16 are design with a planer circular bottom 19, an annular outer wall 18 being attached to an outer annular part of the planer circular bottom 19, and an annular inner wall 24 is also attached to the planer circular bottom 19 at a cutout circular center 25 thereof. The outer annular wall 18 is designed in a cylindrical conical nature such that the diameter of the outer wall 18 is smallest near the planar circular bottom 19 than everywhere else. The inner annular wall 24 is designed in a cylindrical conical nature such that the diameter of the inner wall 24 is largest near the planar circular bottom 19 than everywhere else. The height of the outer annular wall 18 has a predetermined height which is smaller than a predetermined height of the inner annular wall 24. The inserts 16 are further designed with sectional walls 20 which create predefined compartments within the inserts 16. The sectional walls have a predetermined height that is less than both the outer wall 18 and the inner wall 24. With such a design, the inserts 16 are stackable as shown in FIGS. 1 and 2.

When the inserts 16 are stacked, the bottom part of the outer wall 18 of one insert 16 fits inside the top part of the outer wall 18 of another insert 16. The same is true with the inner wall 24, that is, the top part of one inner wall 24 of one insert 16 fits inside the bottom part of the inner wall 24 of another insert 16. The inserts 16 are prevented from fully entering each other by having the planar circular bottom 19 of one insert 16 make contact with the top part of the sectional walls 20.

Within the inner wall 24, a cross member 22 is placed therein. The cross member 22 is attached to and level with the upper part of the inner wall 24. Each cross member 22 of the inserts 16 have a center section 28 and four cross section arms 23. The height of the cross section arms 23 is smallest near the center section 28 and largest near the inner wall 24. When a person wishes to remove the inserts 16 from the container 10, all that is needed is to grasp hold of the cross member 22 and pull the insert 16 out of the container.

A rod 30 may be used to remove more than one insert 16 at a time. The rod 30 has a handle 31, a shaft 32 and a hook portion 33. The rod 30 is placed into inserts 16 by passing it through the cross member 22 and by using the hook portion 33 to grab the desired insert 16 its cross member 22.

I claim:

1. An insert for use with containers comprising a planar circular bottom, an annular outer wall being circumferentially joined to said planar circular bottom, said planar circular bottom includes a cutout circular center, an annular inner wall being circumferentially joined to said cutout circular center, sectional members being joined to both said outer annular wall and said inner annular wall, said sectional members are further joined to said planar circular bottom, said outer annular wall having a predetermined height which is smaller than a predetermined height of said inner annular wall, handle means for removing the insert from the container, said handle means being disposed inside said inner annular wall, said sectional members having a predetermined height which is smaller than the heights of the outer and inner walls.

2. The insert as defined in claim 1 wherein said outer annular wall is designed in a cylindrical conical nature such that the diameter of said outer wall is smallest near said planar circular bottom than everywhere else.

3. The insert as defined in claim 2 wherein said handle means includes cross means and a removable rod.

4. The insert as defined in claim 1 wherein said inner annular wall is designed in a cylindrical conical nature such that the diameter of said inner wall is largest near said planar circular bottom than everywhere else.

5. The insert as defined in claim 1 wherein said handle means includes cross means such that a center section of said cross means is thinner than an outer section.

6. The insert as defined in claim 1 wherein said handle means includes cross means having a predetermined height.

7. The insert as defined in claim 6 wherein the height of said cross means is smallest at a center than everywhere else.

8. The insert as defined in claim 3 wherein said removable rod has a T-shaped grip at one end and a hook at another end, such that when said rod is pulled by the T-shaped grip, the hook makes contact with said cross means.

9. The insert as defined in claim 1 wherein a plurality of inserts are used in combination with a container.

10. The insert as defined in claim 9 further includes a removable rod that has a T-shaped grip at one end and a hook at another end, such that when said rod is pulled by the T-shaped grip, the hook makes contact with said handle means.

11. An insert for use with containers comprising a planar circular bottom, an annular outer wall being circumferentially joined to said planar circular bottom, said planar circular bottom includes a cutout circular center, an annular inner wall being circumferentially joined to said cutout circular center, sectional members being joined to both said outer annular wall and said inner annular wall, said sectional members are further joined to said planar circular bottom, said outer annular wall having a predetermined height which is smaller than a predetermined height of said inner annular wall, handle means for removing the insert from the container, said handle means being disposed inside said inner annular wall, said sectional members having a predetermined height which is smaller than the heights of the outer and inner walls, said outer annular wall is designed in a cylindrical conical nature such that the diameter of said outer wall is smallest near said planar circular bottom than everywhere else, said inner annular wall is designed in a cylindrical conical nature such that the diameter of said inner wall is largest near said planar circular bottom than everywhere else.

* * * * *